US009061852B2

(12) United States Patent
Honegger

(10) Patent No.: US 9,061,852 B2
(45) Date of Patent: Jun. 23, 2015

(54) APPARATUS FOR THE INTERMEDIATE STORAGE OF PLANAR ARTICLES, IN PARTICULAR PRINT PRODUCTS, WHICH CAN BE SPOOLED IN AN IMBRICATED STREAM ARRANGEMENT, AND A METHOD FOR OPERATING SUCH AN APPARATUS

(75) Inventor: Werner Honegger, Bäch (CH)

(73) Assignee: Ferag AG, Hinwil (CH)

( * ) Notice: Subject to any disclaimer, the term of this patent is extended or adjusted under 35 U.S.C. 154(b) by 425 days.

(21) Appl. No.: 13/446,921

(22) Filed: Apr. 13, 2012

(65) Prior Publication Data

US 2013/0008815 A1 Jan. 10, 2013

(30) Foreign Application Priority Data

Apr. 14, 2011 (CH) ..... 0670/11

(51) Int. Cl.

| | |
|---|---|
| ***B65G 21/14*** | (2006.01) |
| ***B65H 5/28*** | (2006.01) |
| ***B65H 29/58*** | (2006.01) |
| ***B65H 29/00*** | (2006.01) |
| ***B65H 29/66*** | (2006.01) |

(52) U.S. Cl.

CPC ..... *B65H 5/28* (2013.01); *B65H 29/006* (2013.01); *B65H 29/58* (2013.01); *B65H 2301/3423* (2013.01); *B65H 2404/254* (2013.01); *B65H 2404/2693* (2013.01); *B65H 2701/1932* (2013.01); *B65H 29/6654* (2013.01); *B65H 2301/4192* (2013.01); *B65H 2301/44712* (2013.01)

(58) Field of Classification Search

None

See application file for complete search history.

(56) References Cited

U.S. PATENT DOCUMENTS

| | | | | |
|---|---|---|---|---|
| 4,541,824 | A | 9/1985 | Müller | |
| 4,580,739 | A | 4/1986 | Linder | |
| 4,697,400 | A | 10/1987 | Gerber | |
| 4,866,910 | A * | 9/1989 | Reist | 53/430 |
| 5,579,889 | A | 12/1996 | Maag | |
| 5,947,463 | A | 9/1999 | Honegger | |
| 6,289,183 | B1 * | 9/2001 | Miyake | 399/16 |
| 2011/0120837 | A1 | 5/2011 | Thériault | |

FOREIGN PATENT DOCUMENTS

| | | | |
|---|---|---|---|
| DE | 33 04219 | A1 | 10/1983 |
| DE | 196 00 809 | A1 | 8/1996 |
| EP | 0 229 888 | A2 | 7/1987 |
| EP | 0 259 650 | A2 | 3/1988 |
| EP | 0 272 398 | A1 | 6/1988 |
| WO | WO 94/02398 | | 2/1994 |

* cited by examiner

*Primary Examiner* — Kavel Singh

(74) *Attorney, Agent, or Firm* — Pauley Petersen & Erickson

(57) ABSTRACT

The invention relates to an apparatus (10) for the intermediate storage of planar articles, which can be spooled in an imbricated stream arrangement, which intermediate storage apparatus (10) has a plurality of substantially mutually adjacent winding stations (D1, . . . , D4), to which the articles to be temporarily stored are fed for spooling on connecting lines (14) or from which the temporarily stored articles, after being unspooled, are led off on the connecting lines (14), as well as at least one supply line (11) and at least one discharge line (12), which cross the connecting lines (14) at predefined junctions. The transfer apparatuses (13) are arranged displaceably on the connecting lines (14), which transfer apparatuses at the junctions selectively connect the connecting lines (14) to the at least one supply line (11), or the at least one discharge line (12), for transfer of the planar articles between the lines (11; 12; 14).

21 Claims, 7 Drawing Sheets

APPARATUS FOR THE INTERMEDIATE STORAGE OF PLANAR ARTICLES, IN PARTICULAR PRINT PRODUCTS, WHICH CAN BE SPOOLED IN AN IMBRICATED STREAM ARRANGEMENT, AND A METHOD FOR OPERATING SUCH AN APPARATUS

CROSS REFERENCE TO RELATED APPLICATION

Swiss Patent Reference 00670/11, filed 14 Apr. 2011, the priority document corresponding to this invention, and its teachings are incorporated, by reference, into this specification.

BACKGROUND OF THE INVENTION

1. Field of the Invention

The present invention relates to the field of the transport and storage of planar articles, in particular within the framework of print finishing. It relates to an apparatus for the intermediate storage of planar articles which can be spooled in an imbricated stream arrangement, according to the preamble to claim 1. It further relates to a method for operating such an apparatus.

2. Discussion of Related Art

In print finishing, also known as print further processing, specifically, a variety of print products, printed sheets, supplements, flyers, etc., once they have been printed, must initially be temporarily stored, so as then to be retrieved from store for the assembly of finished print products, for instance newspapers provided with supplements.

For intermediate storage in a space-saving, flexibly manageable and fast-working manner, winding stations in which the print products arriving in an imbricated stream are spooled onto a winding core for intermediate storage, with the formation of a reel, and are unspooled again for retrieval from store, have proved their worth. Once the reel of print products which is formed in a winding station has reached a maximum diameter, the storage capacity of this winding station is exhausted. In order to accommodate further print products, either a new reel has to be started in the same winding station, or the incoming imbricated stream of print products must be diverted to another winding station. Conversely, if the reel of a winding station is fully unspooled when retrieved from store, either the empty reel must be exchanged for a full reel in the same winding station, or a switch is made to another winding station holding a full reel.

In order to be able to make optimal use of such winding stations as temporary stores, it should be possible, at the same time and without mutual disturbance, to use first winding stations to enter print products into store, whilst print products are retrieved from store from second winding stations, and vice versa.

Printed publication DE 33 04 219 discloses an apparatus for stacking printed sheets, in which a high stacking capacity can be obtained in a comparatively tight space, wherein there are provided 12 buffer and stacking lines, arranged side by side in parallel, which are fed partial imbricated streams via a common feeder conveying line, or from which partial imbricated streams can be transported away via a common evacuation line. In each of the 12 buffer and stacking lines are arranged, on opposite sides of the centrally traversing feeder conveying line and evacuation line, two winding stations, of which one serves for the spooling of the partial imbricated streams and the other for the rewinding of the partial imbricated streams in order to have the desired stream position in the imbricated stream when retrieved from store. The selection of the individual buffer and stacking lines is realized by associated points switch arrangements, which are fixedly disposed on the feeder conveying line and evacuation line and with which the entry into and retrieval from store, and the transverse connection between opposite winding stations, is switched. A drawback with this stacking apparatus is, inter alia, the cost and spatial requirement of the equipment, due to the winding stations which are used in pairs.

Printed publication WO 94/02398 discloses a device for the processing of print products, in which upstream of a processing station is disposed a product store having two storage units for the spooling of print products supplied as an imbricated stream. The print products make their way into the storage units via a feed path, the feed path having a curved feed portion. The retrieval from the individual storage units is realized via a straight store retrieval line up to the processing station. For the appropriate alteration of the conveying paths, a points switch can be used. Here too, increased equipment outlay is necessary, since the transitions between supply lines and discharge lines, as well as the connecting lines leading to the storage units, are to some extent hard-wired.

Printed publication DE 196 00 809 discloses a method for storing planar articles, in which a first part of the articles generated in an imbricated stream formation is spooled into a first reel and at least a further part of the articles into a further reel assigned to the first reel, or unspooled therefrom, wherein the articles are spooled synchronously onto all reels with the same orientation, or unspooled synchronously from all reels with the same orientation. For the implementation of the method, a spooling station, a temporary store and a finishing station, between which the reels are transported to and fro with transport vehicles, are arranged spatially separate from one another. This gives rise to a greater spatial requirement and a flexible, yet comparatively complex process technology.

Printed publication EP 0 229 888 discloses an apparatus for the storage of print products generated in imbricated stream formation, in which, at a common supporting column, one above the other, are arranged a number of similar winding units, which can be turned independently from one another. For the feeding of the print products to be spooled onto the winding cores, a conveyor is present, which conveyor has a height-adjustable outlet region. The spooling units can be individually loaded with print products and also individually emptied again. In this configuration, only ever one winding unit can either be loaded or unloaded. A combined, flexible operation is not possible.

Printed publication EP 0 272 398 discloses a method and a device for transferring printed articles generated in at least one continuous stream to the supply lines of at least two processing stations. In order that the division of the generated stream can be performed as continuously as possible and can be optimally matched to the requirements of the processing stations, the stream is conducted in such a way that it crosses the supply lines, wherein at the intersections the stream is fed at least periodically to a store, whilst at the same intersection printed articles are simultaneously transferred from the store via a transfer point to the supply point. As the storage devices, a twin-reel stand, which respectively supports two reels, is present in the region of each intersection. The reel stands are displaceable along the supply line in order that respectively one of the reels can be aligned to one of the used conveyors, with the other reel being aligned to one of the transfer points at the intersection in question.

Common to the solutions known from the prior art is the fact that, in order to achieve a flexible intermediate storage, they require a comparatively large outlay on equipment, which is at the same time linked to a not inconsiderable spatial requirement.

SUMMARY OF THE INVENTION

One object of the invention is therefore to configure an intermediate storage apparatus of the generic type such that, given reduced spatial requirement and equipment outlay, high operating flexibility is obtained.

A further object of the invention is to define a method for operating such an apparatus.

These and other objects are achieved by virtue of the features of claims 1 and 22.

The invention is based on an apparatus for the intermediate storage of planar articles, in particular print products, which can be spooled in an imbricated stream arrangement, which intermediate storage apparatus has a plurality of substantially mutually adjacent winding stations, to which the articles to be temporarily stored are fed for spooling on connecting lines or from which the temporarily stored articles, after being unspooled, are led off on the connecting lines, as well as at least one supply line and at least one discharge line, which cross the connecting lines at predefined junctions. It is distinguished by the fact that transfer apparatuses are arranged displaceably on the connecting lines, which transfer apparatuses at the junctions selectively connect the connecting lines to the at least one supply line, or the at least one discharge line, for transfer of the planar articles between the lines.

As a result of the displaceable transfer apparatuses, individual junctions amongst those which are essentially present can be "activated" according to requirement by transfer apparatuses being moved to these junctions so as to periodically establish there an actual transfer path between the intersecting lines. In this way, at the unneeded "passive" junctions, it is possible to save on apparatuses for transfer of the articles, which helps to reduce the equipment outlay. The matrix-like configuration which is used for this purpose is compact and space-saving.

One embodiment of the intermediate storage apparatus is characterized in that the connecting lines are arranged parallel to one another, in that the at least one supply line and the at least one discharge line run parallel to one another, in that the lines intersect at right angles in the manner of a matrix, and in that in the transfer apparatuses the planar articles are respectively diverted by 90°.

According to another embodiment of the invention, the winding stations with their connecting lines are grouped in pairs.

A further embodiment of the intermediate storage apparatus according to the invention is distinguished by the fact that the transfer apparatuses are individually and independently displaceable, and that, for the displacement of the transfer apparatuses, a controllable drive motor is respectively provided. This allows particularly high operating flexibility.

Preferably, the controllable drive motor is here respectively arranged fixedly on the connecting line and is operatively connected to the assigned transfer apparatus by power transmission means. The structure of the apparatus can hereby be simplified. The power transmission means can, in particular, comprise a drive chain.

According to another embodiment of the invention, along the connecting lines, conveying means for transporting the planar articles on the first lines are provided between the transfer apparatuses and the winding stations.

In particular, the conveying means comprise conveyor belts circulating in the longitudinal direction of the connecting lines, the running direction of the conveyor belts being reversible in order to reverse the transport direction.

Preferably, the conveyor belts are here led through the transfer apparatuses on rollers.

Secure transport, with, at the same time, limited outlay, is achieved by virtue of the fact that, according to another embodiment, two parallel conveyor belts are provided for each connecting line.

According to another embodiment, means for transporting the planar articles through the transfer apparatus between the connecting lines and the at least one supply line, or the at least one discharge line, are provided within the transfer apparatuses.

In particular, the means for transporting the planar articles through the transfer apparatus respectively comprise a transport means and a pressure means, between which the planar articles are transported horizontally.

Preferably, the transport means is in this case driven, whilst the pressure means rests on the planar articles and is passively jointly moved.

It is particularly space-saving if the two means form a transport line which runs through the transfer apparatus and is configured in the style of a loop as a distorted space curve.

Another embodiment is characterized in that the transport means is respectively driven via a power transmission means circulating along the connecting line, into which power transmission means the transfer apparatus is looped. The power transmission means can be, in particular, a drive belt.

It is here of advantage if the power transmission means or the drive belt is driven via a clutch mechanism by and synchronously with the associated winding station. In this way, a simple synchronization between winding station and transfer apparatus is obtained, whilst simultaneously saving on additional drive and control means.

In the same way, the conveying means for transporting the planar articles on the connecting lines can also be driven via a clutch mechanism by and synchronously with the associated winding station.

The flexibility of the intermediate storage can be easily increased by the provision of a plurality of supply lines and/or discharge lines.

In addition, it is expedient if, according to another embodiment, intermediate stations for preparing the retrieved imbricated stream of planar articles for subsequent treatment steps are disposed at the end of the discharge line(s).

In particular, the intermediate stations can be configured to change the position of the planar articles relative to one another in the imbricated stream.

Moreover, the intermediate stations can have an additional inlet for the supply of additional flat articles via an adjacent feed apparatus, in order to increase flexibility.

For the same reason, the intermediate stations can have various delivery paths.

The inventive method for operating an intermediate storage apparatus according to the invention is characterized in that, for the spooling of flat articles led up via a selected supply line in a selected winding station, the transfer apparatus belonging to the selected winding station, on the connecting line belonging to the selected winding station, is moved to the junction of the selected supply line with the connecting line belonging to the selected winding station, and in that, for the discharge of flat articles unspooled in the selected winding station, the associated transfer apparatus is moved via a selected discharge line to the junction of the selected discharge line with the connecting line belonging to the selected winding station, and the transport direction of the flat articles in the associated transfer apparatus and on the connecting line is reversed.

BRIEF DESCRIPTION OF THE DRAWINGS

The invention shall be explained in greater detail below on the basis of illustrative embodiments in connection with the drawing, wherein.

DESCRIPTION OF PREFERRED EMBODIMENTS

Figure 1:
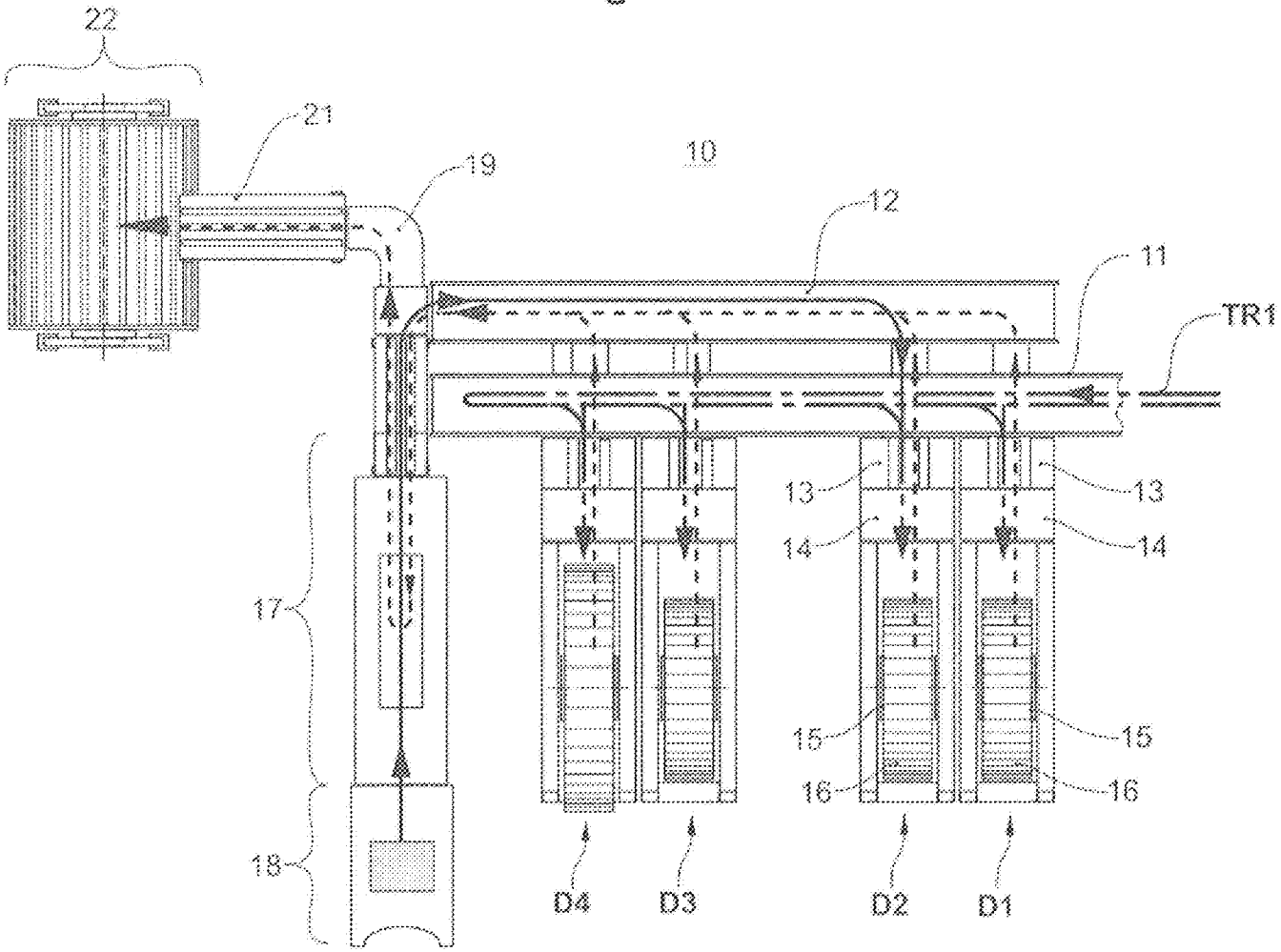
FIG. 1 shows in top view from above a first illustrative embodiment of an intermediate storage apparatus according to the invention, having four winding stations as well as one supply line and one discharge line.

In FIG. 1, a first illustrative embodiment of an intermediate storage apparatus according to the invention is represented in top view. The intermediate storage apparatus 10 of FIG. 1 comprises in total four winding stations D1-D4, which are arranged side by side in parallel, grouped into pairs. In the winding stations D1-D4, the planar articles arriving in imbricated stream formation are spooled onto a winding core 15, in a manner which is known per se, to form a reel 16 and are temporarily stored in the form of the reel 16. The winding cores 15 or reels 16 are mounted respectively in the winding stations D1-D4 rotatably about an axis, the axes of the various winding stations being arranged parallel to one another. For the entry into store and retrieval from store of the articles from the same side, the winding stations D1-D4 are all connected by parallel connecting lines 14 to the other parts of the intermediate storage apparatus 10.

Running transversely to the connection lines 14 is a supply line 11, and parallel to the supply line 11 a discharge line 12. The supply line 11 is configured as a circulating, belt-like transport mechanism (see also FIG. 3), via which the articles to be entered into store are led up in the form of an imbricated stream and diverted and transferred selectively onto the connecting lines 14. The transfer is realized in the lower return circuit of the supply line 11, in which, at the junctions between the supply line 11 and the connecting lines 14 running beneath it, lowerable portions or other points switches are provided, via which the imbricated stream can be transferred at this point to the respectively underlying connecting line 14. For the actual transfer of the articles, transfer apparatuses 13 are provided (see also FIGS. 8 and 9), which transfer apparatuses are discussed in greater detail later.

Figure 3:
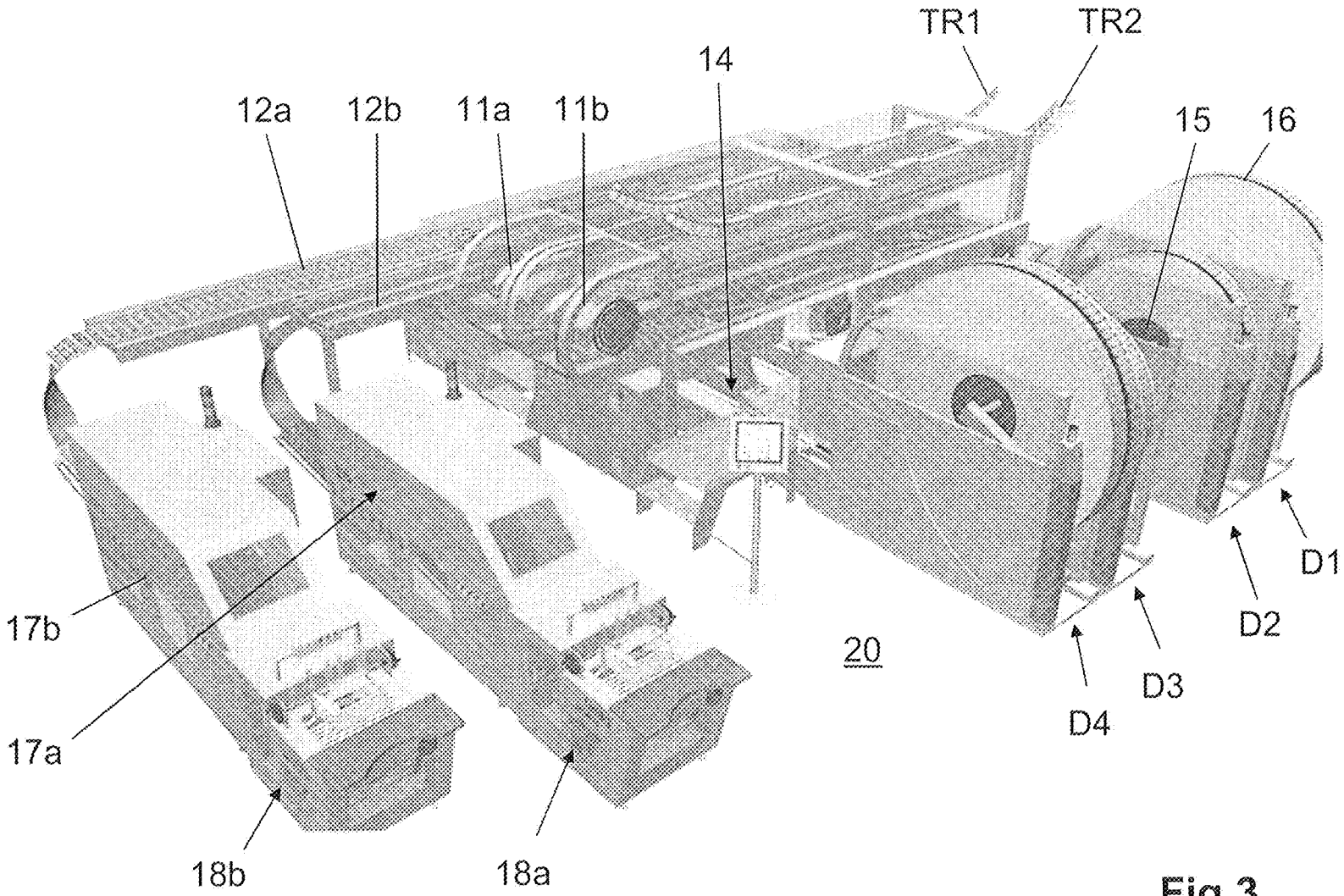
FIG. 3 shows a perspective representation of a part of the apparatus from FIG. 2.

The supply line 11 can be supplied with the planar articles, for instance, via a conveyor TR1, for example in the form of a gripper conveyor which is known per se. To this end, the conveyor TR1, as shown in FIG. 3, is guided over a certain distance parallelly along the supply line 11 and (by opening of the grippers) deposits the articles on the supply line 11 in imbricated stream formation.

Parallel to and behind the supply line 11, the discharge line 12 is guided transversely over the connecting lines 14. Via the discharge line 12, the (retrieved) articles unspooled from a reel 16 in one of the winding stations D1-D4 are forwarded for further processing to a treatment station 22, which in the shown example is configured as a known inserting drum. The articles are also transported in the form of an imbricated stream via the discharge line 12, which articles can have a different imbricated stream arrangement than on the supply line 11. If the articles in question, for instance, are printed sheets which are folded along a folding edge and which are fed to one of the winding stations D1-D4 with the folding edge first, then the printed sheets are forwarded in the imbricated stream of the discharge line 12 with the folding edge to the rear, or with the bloom first.

In order to restore the original imbricated stream formation, the articles, at the end of the discharge line 12, are led into an intermediate station 17, in which an appropriate rearrangement of the imbricated stream formation is performed. The intermediate station 17, which is discussed in greater detail later in connection with FIGS. 4-7, can simultaneously be used for further operating modes, which further increase the flexibility of the apparatus. To this end, to the intermediate station 17 can be assigned, in particular, a feed apparatus 18 (for example, of the type known on the market as "JetFeeder" of the present Applicant) (see also FIGS. 5 and 6), via which other articles can be fed from outside into the processing operation. The rearranged articles coming out of the intermediate station 17 are fed via a diverting apparatus 19 and a corresponding feed apparatus 21 into the treatment station 22.

In the intermediate storage apparatus 10 shown in FIG. 1, the four parallel connecting lines 14 and the intersecting supply line 11 and discharge line 12 form a 2×4 matrix comprising 2 lines and 4 columns and a total of 8 junctions. This configuration enables articles to be spooled onto a reel 16 in a first winding station for intermediate storage, whilst, at the same time, in another, second winding station, articles are unspooled from an existing reel 16 and thus retrieved from store. To this end, the first winding station is connected by the associated transfer apparatus 13 on the associated connecting line 14 to the supply line 11, whilst the second winding station is connected by the associated transfer apparatus 13 on the associated connecting line 14 to the discharge line 12. The transport directions of the two transfer apparatuses 13 and connecting lines 14 are here respectively opposed.

Should a switch then be made in the first winding station from the spooling process to an unspooling process, the associated transfer apparatus 13 is displaced, i.e. spatially moved, on its connecting line 14 from the junction with the supply line 11 to the junction with the discharge line 12. At the same time, the transport direction in the transfer apparatus 13 and on the connecting line 14 is reversed.

If, in the second winding station, on the other hand, a switch is made from the unspooling process to a spooling process, the associated transfer apparatus 13 is displaced on its connecting line 14 from the junction with the discharge line 12 to the junction with the supply line 11. At the same time, the transport direction in the transfer apparatus 13 and on the connecting line 14 is reversed.

In order that the selective linkage of the winding stations D1-D4 to the supply line 11 and the discharge line 12 via the corresponding junctions can be realized smoothly, the transfer apparatuses 13 are arranged displaceably on their associated connecting lines 14. For the displacement of the transfer apparatuses 13, a motor drive (drive motor 38 in FIG. 8) is respectively provided, which drive motor is disposed at that end of the connecting line 14 which faces the winding station. The power transmission is realized, for instance, via a chain, which circulates along the connecting line 14 and into which the transfer apparatus 13 is looped. The transfer apparatus 13 itself is mounted displaceably on the top side of the displacement line 14 on rails or by means of linear guides, The displacement or movement of the transfer apparatuses 13 can be realized by direct movement thereof, or else by movement thereof by means of separately driven rail cars. Their various working positions can be predefined by mechanical positioning means, by sensors or by appropriately controlled linear drives. In complex apparatuses, for example owing to design-related and/or logistical framework conditions, movements, which are spatially not purely linear, between the various working positions of the transfer apparatuses are preferably also possible within the scope of the invention.

Self-evidently, other matrix configurations of winding stations and supply or discharge lines than those shown in FIG. 1 are possible within the scope of the invention. Thus in FIG. 2 a 6×4 matrix is represented, in which six winding stations D1-D6 are arranged in pairs and parallel to one another and can selectively be connected to respectively two supply lines 11*a,b* and two discharge lines 12*a,b*. The intermediate storage apparatus 20' represented in FIG. 2 has, in turn, for each connecting line 14, a transfer apparatus 13 displaceable on this line, so that in total six transfer apparatuses are present. Each of the six transfer apparatuses 13 is displaceable on its connecting line 14 between four junctions which are formed by the connecting line 14 and the two transversely running supply lines 11*a,b* and two transversely running discharge lines 12*a,b*.

Due to the 6×4 matrix arrangement, articles can simultaneously be entered into store in two different winding stations via the two supply lines 11*a,b*, and retrieved from store from two other winding stations via the two discharge lines 12*a,b*. The two supply lines 11*a,b* are supplied by associated conveyors TR1 and TR2 with the articles to be entered into store, whilst a combination of an intermediate station 17*a,b* and a feed apparatus 18*a,b* is respectively disposed at the end of each of the discharge lines 12*a,b*. Correspondingly, the articles are relayed via diversion apparatuses 19*a,b* and feed apparatuses 21*a,b* to a following treatment station 22.

Figure 2:
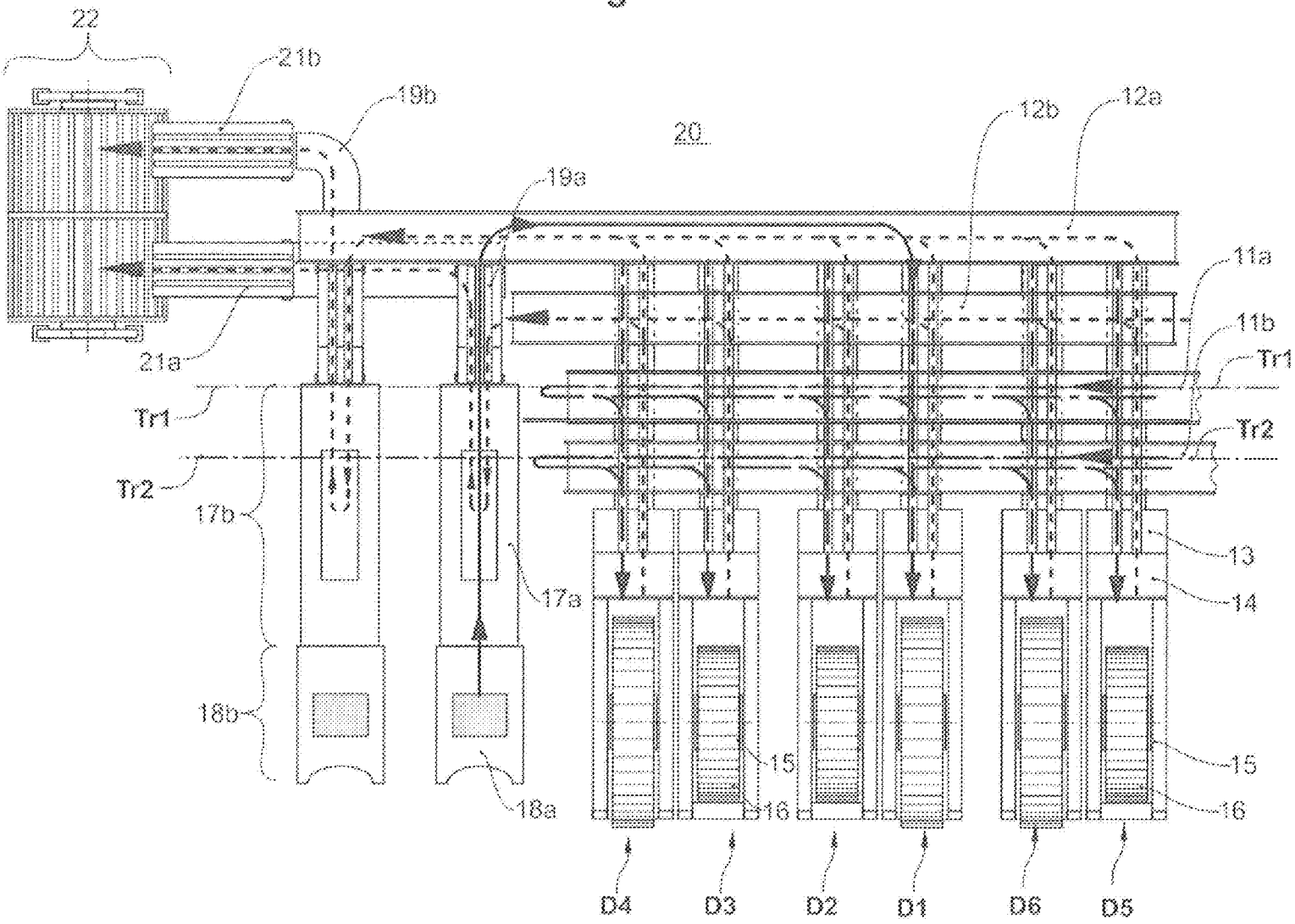
FIG. 2 shows in top view from above a second illustrative embodiment of an intermediate storage apparatus according to the invention, having six winding stations as well as two supply lines and two discharge lines.

FIG. 3 portrays in a perspective view an intermediate storage apparatus 20, which emerges from the apparatus of FIG. 2 through the omission of the additional winding stations D5 and D6, as well as of the treatment station 22, the feed apparatuses 21*a,b* and the diversion apparatuses 19*a,b*. In the representation of FIG. 3, it is clearly apparent that the supply lines 11*a,b* are configured as circulating transport means and the delivery of the articles at the junctions is realized in the lower return circuit via lowerable line portions. It is further apparent that the connection between the ends of the discharge lines 12*a,b* and the inlets of the intermediate stations 17*a,b* is realized via transport lines, which have the form of a space curve distorted in the style of a "partial loop" and enable a 90° change of direction of the imbricated stream. Comparable transport lines or space curves are disposed in the transfer apparatuses 13. Finally, it is also apparent that the conveyors TR1 and TR2 above the supply lines 11*a,b* run parallel for a way and there deliver the articles to the supply lines 11*a,b*.

Figure 4:
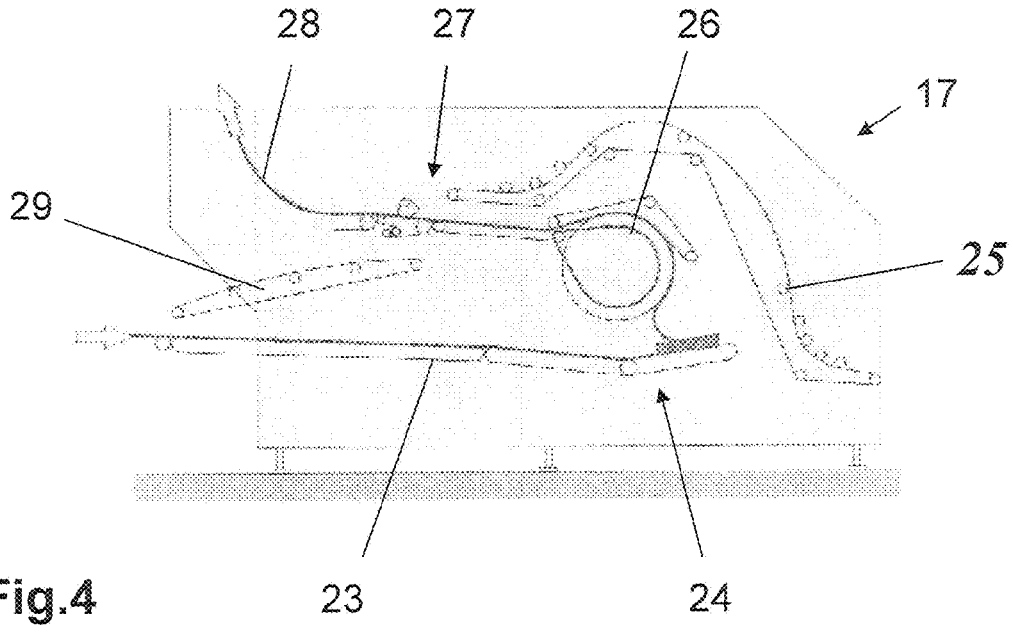
FIG. 4 shows in a side view a schematic representation of an intermediate station according to FIG. 1 in a first operating mode.

The intermediate stations 17 or 17*a,b* shown in FIGS. 1-3 have, for instance, an inner structure which in FIG. 4 is represented schematically in a side view. The central component of the intermediate station 17 is a rearranging apparatus, which comprises a supply line 23, a transfer station 24, a pull-off apparatus 26 and a discharge line 28. The arriving imbricated stream of articles makes its way via the supply line 23 to the transfer station 24, forms there an intermediate stack of articles, from which the pull-off apparatus 26 successively pulls off the articles at the top in opposite directions and delivers them outwards via the discharge line 28, the transport direction of the individual articles being reversed.

The intermediate station 17 of FIG. 4 further has a conveying line 25, which leads from another (opposite) inlet around the pull-off apparatus and can be connected by a points switch 27 selectively to the discharge line 28 or to a further discharge line 29. The purpose and advantage of the conveying line 25 emerges from FIG. 5, which shows a configuration in which a feed apparatus 18 is connected to the intermediate station 17 in such a way that the articles supplied by the feed apparatus 18 can be transferred directly to the conveying line 25 (see FIG. 5). In this way, additional or other articles which are present on the feed apparatus 18, for instance in the form of a stack 31 and are pulled off from the stack by means of a pull-off apparatus 32, can be fed via the conveying line 25 and the discharge line 28 into the processing process, as is represented by way of example in FIG. 1.

Figure 5:
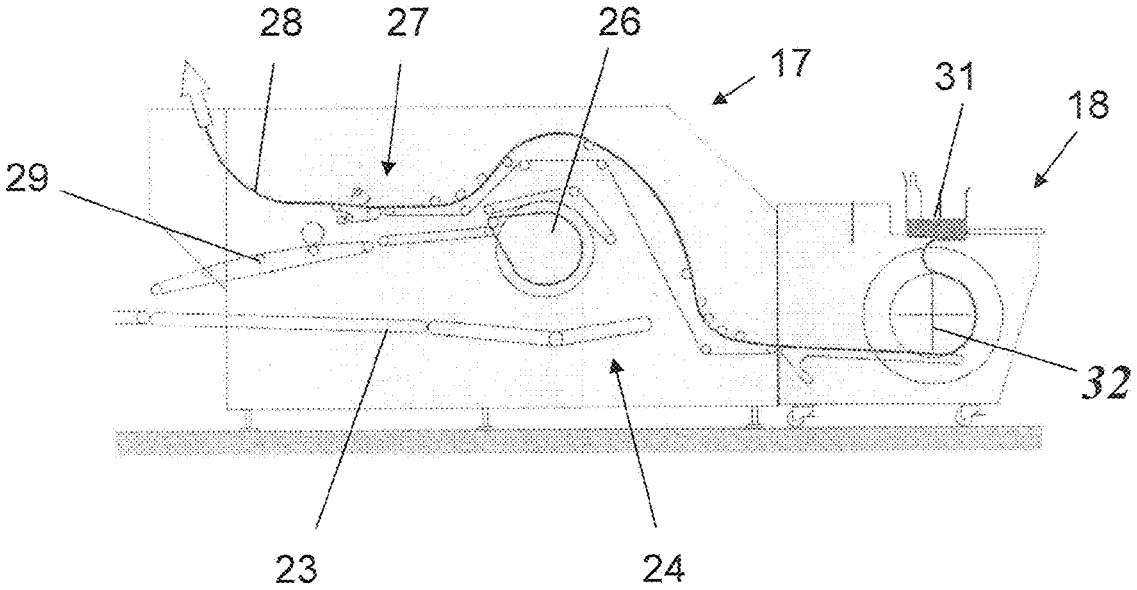
FIG. 5 shows in a side view a schematic representation of the intermediate station from FIG. 4, with an additional feed apparatus, in a second operating mode.
Figure 6:
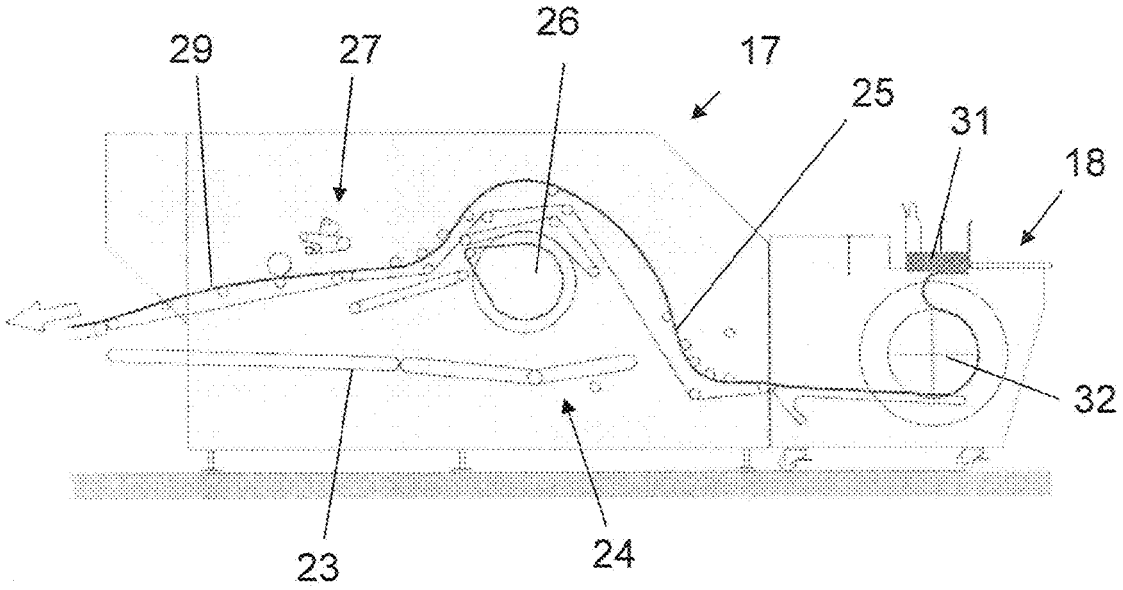
FIG. 6 shows in a side view a schematic representation of the intermediate station from FIG. 4, with an additional feed apparatus, in a third operating mode.

With the configuration of FIG. 5, it is also possible, however, by switching of the points switch 27, to produce an operating mode in which additionally supplied articles are delivered in some other way via the discharge line 29 as an imbricated stream formation (FIG. 6). One of these possibilities consists in depositing the articles via the discharge line 29 on the discharge line 12 (FIG. 1) or 12*a* (FIG. 2), which is here operated in the reverse transport direction and transports the articles to a winding station (D2 in FIG. 1 or D1 in FIG. 2) (unbroken arrows, bending off to the right, in FIGS. 1, 2). In this way, articles which have been fed in separately from outside are spooled in a winding station and temporarily stored.

Figure 7:
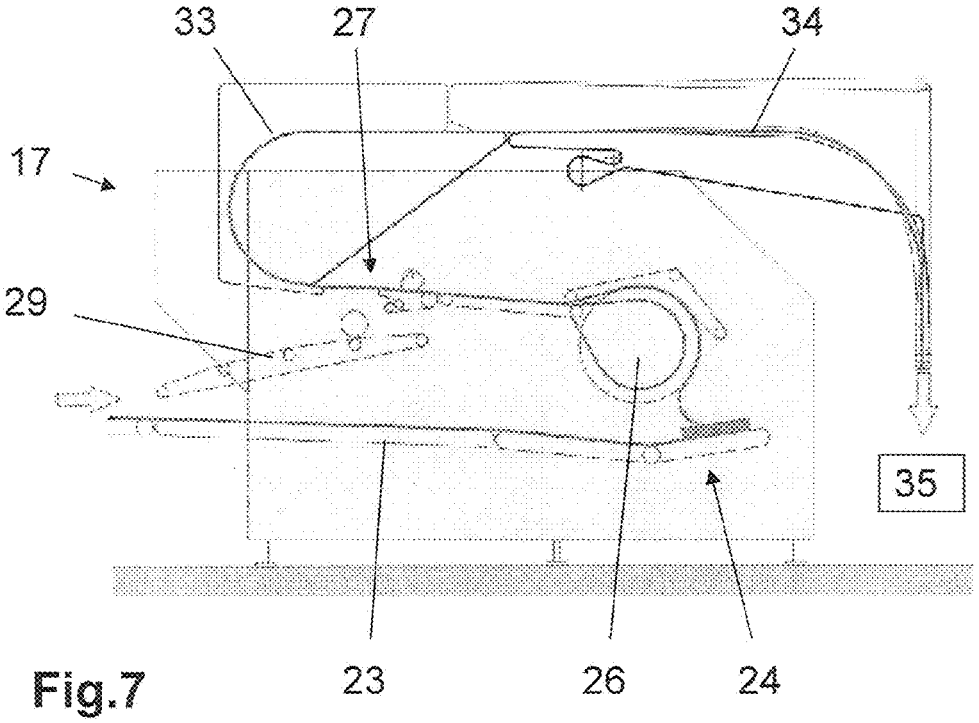
FIG. 7 shows in a side view a schematic representation of an intermediate station according to FIG. 1, in a fourth operating mode.

The intermediate station 17 of FIG. 4 can also however be used, according to FIG. 7, to supply the rearranged articles, given appropriate setting of the points switch 27, via appropriate conveying lines 33 and 34 to a collecting line 35, where they are collated with other articles to form more complex print products. One example of such a collecting line is the apparatus of the Applicant which is known under the designation "FlyStream".

In the intermediate storage apparatuses 10, 20 and 20' of FIGS. 1-3, particular importance is attached to the transfer apparatuses 13 arranged displaceably on the connecting lines 14, because not only do they have to establish the transport-related connection between the connecting line 14 and the supply lines 11, 11*a,b* or discharge lines 12, 12*a,b*, in which a 90° diversion must be made and a height difference between the lines situated at different levels must be surmounted, but they also—together with the connecting line 14—have to be designed to be reversible with respect to the transport direction.

Figure 8:
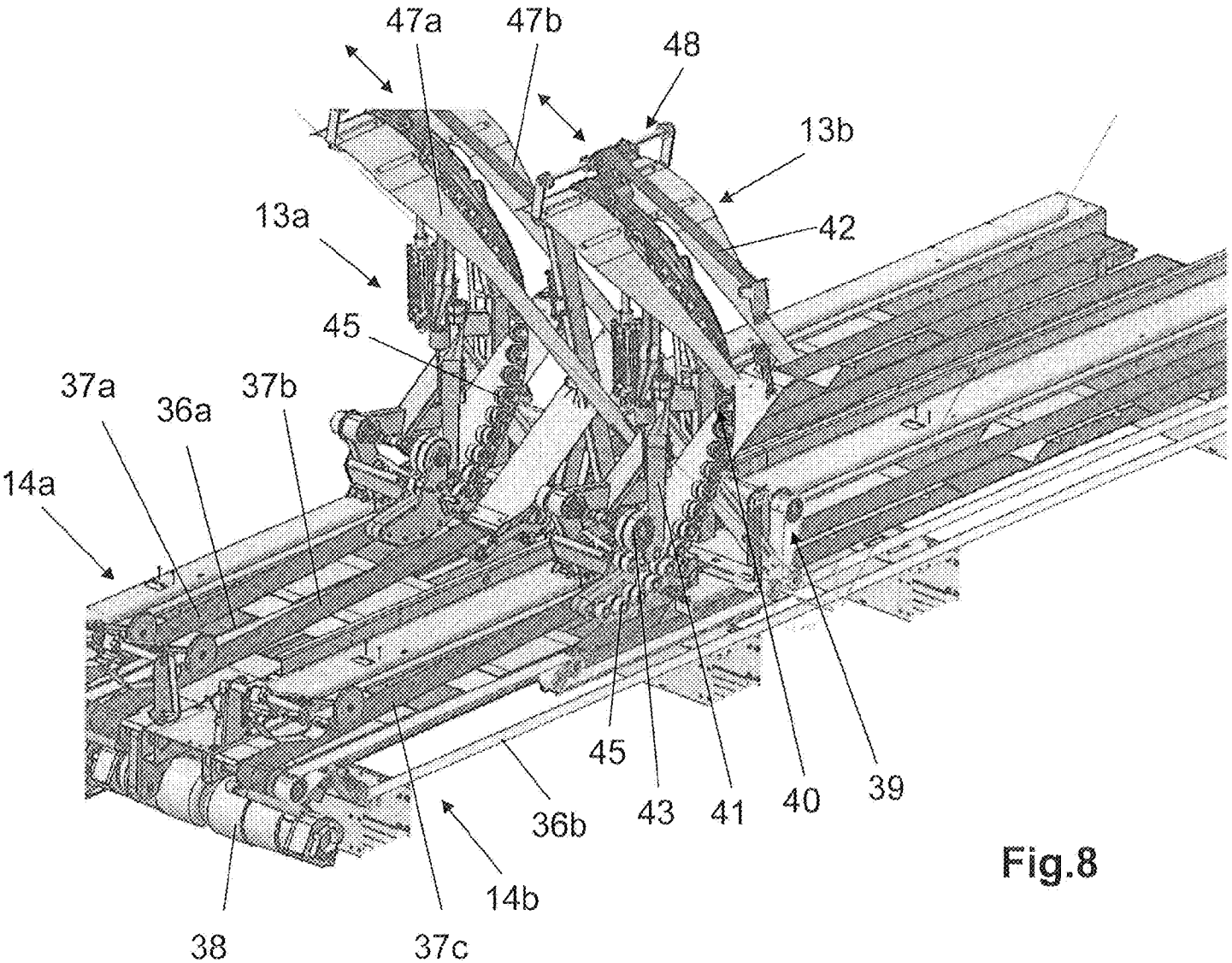
FIG. 8 shows in a perspective side view two parallel connecting lines for linking the winding stations in an apparatus according to FIG. 1, with thereon displaceable transfer apparatuses according to another illustrative embodiment of the invention.
Figure 9:
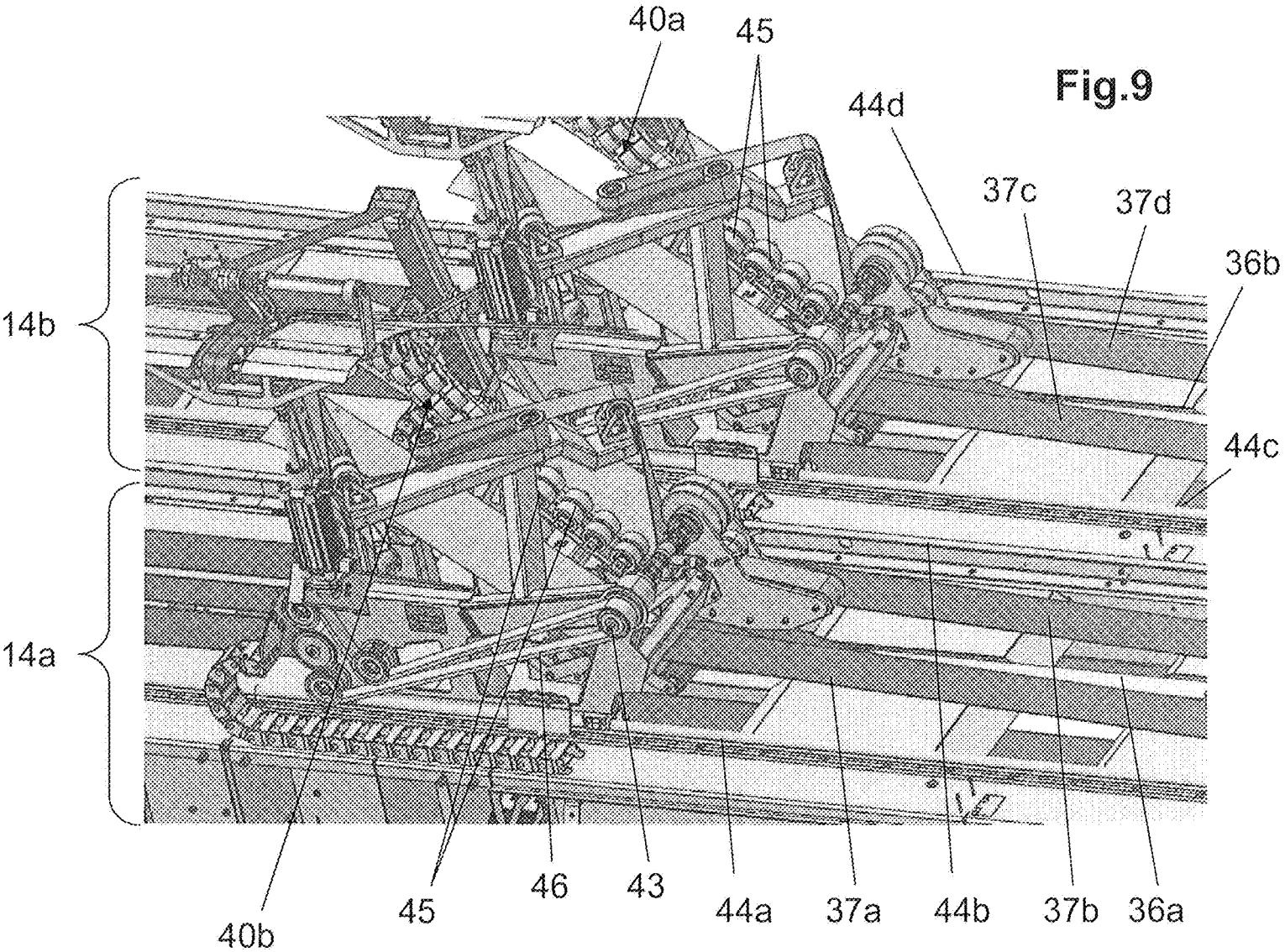
FIG. 9 shows in a perspective side view, in enlarged representation, the transfer apparatuses from FIG. 8.

Suitable illustrative embodiments of such transfer apparatuses 13*a,b* are represented in FIGS. 8 and 9. FIG. 8 shows two directly adjoining, mutually parallel connecting lines 14*a* and 14*b*. Each of the two connecting lines 14*a,b* has two circulating conveyor belts 37*a-d* which pass through over the entire length. Of the connecting line 14*b*, only one of the conveyor belts 37*c* is shown in FIG. 8. The second conveyor belt is omitted so as to open up an unobstructed view onto a drive belt 36*b* disposed between the two conveyor belts, which drive belt is responsible for driving the transport mechanism in the associated transfer apparatus 13*b*. On the other connecting line 14*a*, a corresponding drive belt 36*a* is present between the two conveyor belts 37*a* and 37*b*. The drive belts 36*a,b* are preferably configured as toothed belts, but can also be replaced by other elements, such as, for example, chains.

The conveyor belts 37*a-d* and the drive belts 36*a,b* for the transfer apparatuses 13*a,b* are preferably driven via a mechanical coupling (for example a cardan shaft), by a main drive which is housed in the respective winding station D1-D4 and which both drives and controls the reel during spooling and unspooling. In this way, the spooling and unspooling process in the winding station, and the transport process on the connecting line and in the transfer apparatus, always run synchronously. However, a dedicated drive can also be provided for the conveyor belts 37*a-d* and the drive belts 36*a,b*, which dedicated drive is then appropriately synchronized with the other drives.

The two transfer apparatuses 13*a* and 13*b* are respectively displaceably mounted and guided on the connecting lines 14*a* and 14*b* in the manner of a slide on two parallel rails 44*a,b* or 44*c,d* (FIG. 9). As already mentioned earlier, the transfer apparatuses 13*a,b* are respectively displaced via a chain drive by means of a drive motor 38 disposed at the end of the connecting lines 14*a,b*. In each transfer apparatus 13*a,b* is configured a diversion line 40*a* or 40*b*, which has the form of an intrinsically distorted space curve in the style of a loop and diverts by 90°, and hereby turns, the imbricated stream to be transferred. At the same time, the diversion line 40*a,b* is used to bridge a height difference which exists between the connecting lines 14*a,b* and the supply lines 11, 11 *a,b* and discharge lines 12, 12*a,b* running transversely over them.

The diversion lines 40*a,b* are respectively formed by a row of running rollers 45 which follows the space curve and over which a driven transport means 41 runs. The transport means 41 is driven by the drive belt 36*a,b* via two parallel drive axles 39 and 43, which are operatively connected to each other by a belt drive 46 (FIG. 9). On the top side of the transport means 41, a pressure means 42 nestles against the diversion line 40*a,b*. The pressure means 42, which has no drive of its own, in this way presses onto the transport means 41 the imbricated stream transported on the diversion line 40*a,b*, so that the imbricated stream of articles is securely guided between the two belts 41 and 42. For the lateral support of the articles in the transported imbricated stream, parallel-running supporting strips 47*a,b* are disposed on both sides of the roller track formed by the running rollers 45 (FIG. 8).

In each of the transfer apparatuses 13*a,b*, the diversion line 40 or 40*a,b* ends upwardly in a connecting part 48 (FIG. 8), with which the connection of the diversion line 40 or 40*a,b*, and thus the transfer apparatus 13*a,b*, to one of the supply lines 11 or 11 *a,b* or discharge lines 12 or 12*a,b* can be established. To this end, the connecting part 48 is configured such that it is vertically displaceable, which can be realized, for instance, by a hydraulic or pneumatic adjusting mechanism.

Both the conveyor belts 37*a-d* in the connecting lines 14*a,b* and the lower belts 41 driven via the drive belts 36*a,b* can be operated reversibly in opposite directions, so that the connecting lines 14*a,b* and transfer apparatuses 13*a,b* establish the connection between the winding stations D1-D4 and the supply lines 11, 11*a-b* and discharge lines 12, 12*a,b* when the articles are both entered into and retrieved from storage.

The described arrangement, with which the articles are transported and transferred in the form of imbricated streams, can also be used, given suitable operation, either to condense the imbricated stream by shortening the distance between successive articles or extend it by lengthening the distance between the same. Such a change in imbricated stream density is achieved by virtue of the fact that the transport speed of the imbricated stream is chosen differently before and after the transfer between two lines: For stretching of the imbricated stream, the post-transfer transport speed is higher, for compression it is lower. By turning the imbricated stream in the transfer apparatus 13, 13*a,b*, it is here possible to ensure that the foremost article in the imbricated stream always comes to lie at the very bottom. In particular, it is thereby possible to spool the imbricated stream in condensed form.

For the spooling or storage in a selected winding station D1, . . . , D4 of articles led up via a selected supply line 11, 11*a,b*, the transfer apparatus 13, 13*a,b* belonging to the selected winding station D1 . . . , D4 is now moved on the connecting line 14, 14*a,b* belonging to the selected winding station D1, . . . , D4, by means of the above-described drive mechanism, to the junction of the selected supply line 11, 11*a,b* with the connecting line 14, 14*a,b* belonging to the selected winding station D1, . . . , D4.

For the discharge or retrieval from storage of flat articles unspooled in the selected winding station D1, . . . , D4 via a selected discharge line 12, 12*a,b*, the associated transfer apparatus 13, 13*a,b* is moved to the junction of the selected discharge line 12, 12*a,b* with the connecting line 14, 14*a,b* belonging to the selected winding station D1, . . . , D4 and the transport direction of the imbricated stream of articles in the associated transfer apparatus 13, 13*a,b* and on the connecting line 14, 14*a,b* is reversed.

In particular embodiments, it may be advantageous to arrange the supply line 11, 11*a,b* and the discharge line 12, 12*a,b* not substantially at right angles to the connecting lines 14, 14*a,b*, but at a certain angle thereto. In this way, the transfer apparatuses 13, 13*a,b*, with their space curves, can be tailored to particular requirements and it is possible to achieve a situation in which, for instance, the diversion effected by these transfer apparatuses—viewed in plan view—must cover not 90°, but only 70°, for instance. Moreover, such arrangements enable account to be taken of particular circumstances in corresponding workshops.

In other illustrative embodiments, it is preferably provided that the parallel-running supply lines 11, 11*a,b* and discharge lines 12, 12*a,b* have their inlet and outlet points at opposite ends. This allows further variability of the intermediate storage apparatus.

A further variant of the invention uses transfer apparatuses 13, 13*a,b* which are not assigned fixedly to a winding station, but are movable between the lines of two winding stations (e.g. with a movement substantially parallel to the supply/discharge lines 11, 12 in FIG. 1). Thus, a first, as well as three further transfer apparatuses (one for each supply/discharge line) can be movable, for instance, to and fro between the winding stations D5 and D6. In such solutions, account can be taken of the fact that the path of movement is minimized if the distances apart of the supply and discharge lines 11*a,b* and 12*a,b*, assuming a given arrangement in relation to the distance apart of the winding stations (D5, D6 according to the example), is significantly greater. In this case, the transfer apparatuses 13, 13*a,b* would have to be disconnectable from the connecting lines 14, 14*a,b* to allow changing between the connecting lines 14, 14*a,b*.

I claim:

1. An apparatus (10, 20, 20') for the intermediate storage of planar articles, in particular print products, which can be spooled in an imbricated stream arrangement, comprising:

a plurality of substantially mutually adjacent winding stations (D1, . . . , D4) including at least a first winding station and a second winding station, to which the planar articles to be temporarily stored are fed for spooling on connecting lines (14, 14*a,b*) or from which the temporarily stored articles, after being unspooled, are led off on the connecting lines (14, 14*a,b*);

at least one supply line (11, 11*a,b*) and at least one discharge line (12, 12*a,b*), which cross the connecting lines (14, 14*a,b*) at predefined junctions; and transfer apparatuses (13, 13*a,b*) arranged displaceably on the connecting lines (14, 14*a,b*), which transfer apparatuses at the predefined junctions selectively connect the connecting lines (14, 14*a,b*) to the at least one supply line (11, 11*a,b*), or the at least one discharge line (12, 12*a,b*), for transfer of the planar articles between the supply line, the discharge line, and the connecting lines (11, 11*a,b*; 12, 12*a,b*; 14, 14*a,b*), wherein the transfer apparatuses (13, 13*a,b*) allow for switching the first winding station from an unspooling process to a spooling process without disturbing use of the second winding station.

2. The intermediate storage apparatus according to claim 1, wherein the connecting lines (14, 14*a,b*) are arranged parallel to one another, in that the at least one supply line (11, 11*a,b*) and the at least one discharge line (12, 12*a,b*) run parallel to one another, in that the lines (11, 11*a,b*; 12, 12*a,b*; 14, 14*a,b*) intersect substantially at right angles in the manner of a matrix, and in that in the transfer apparatuses (13, 13*a,b*) the planar articles are respectively diverted by substantially 90°.

3. The intermediate storage apparatus according to claim 1, further comprising:

a controllable drive motor (38) for the individual and independent displacement of the transfer apparatuses (13, 13*a,b*).

4. The intermediate storage apparatus according to claim 3, wherein the controllable drive motor (38) is respectively arranged fixedly on the connecting line (14, 14*a,b*) and is operatively connected to the assigned transfer apparatus (13, 13*a,b*) by power transmission means.

5. The intermediate storage apparatus according to claim 1, further comprising:

conveying means (37*a-d*) positioned between the transfer apparatuses (13, 13*a,b*) and the winding stations (D1, . . . , D4), along the connecting lines (14, 14*a,b*), for transporting the planar articles on the first lines (14, 14*a,b*).

6. The intermediate storage apparatus according to claim 5, wherein the conveying means comprise conveyor belts (37*a-d*) circulating in a longitudinal direction of the connecting lines (14, 14*a,b*), and in that a running direction of the conveyor belts (37*a-d*) is reversible in order to reverse the transport direction.

7. The intermediate storage apparatus according to claim 6, wherein the conveyor belts (37*a-d*) are led through the transfer apparatuses (13, 13*a,b*) on rollers.

8. The intermediate storage apparatus according to claim 6, wherein two parallel conveyor belts (37*a,b* or 37*c,d*) are provided for each connecting line.

9. The intermediate storage apparatus according to claim 1, further comprising:

a means (41, 42) for transporting the planar articles through the transfer apparatus (13, 13*a,b*) between the connecting lines (14, 14*a,b*) and the at least one supply line (11, 11*a,b*), or the at least one discharge line (12, 12*a,b*), provided within the transfer apparatuses (13, 13*a,b*).

10. The intermediate storage apparatus according to claim 9, wherein the means for transporting the planar articles through the transfer apparatus (13, 13*a,b*) respectively comprise a transport means (41) and a pressure means (42), between which the planar articles are transported horizontally.

11. The intermediate storage apparatus according to claim 10, wherein the transport means (41) is driven, whilst the pressure means (42) rests on the planar articles and is passively jointly moved.

12. The intermediate storage apparatus according to claim 10, wherein the two means (41, 42) form a transport line which runs through the transfer apparatus (13, 13*a,b*) and is configured in the style of a loop as a distorted space curve.

13. The intermediate storage apparatus according to claim 11, wherein the transport means (41) is respectively driven via a power transmission means circulating along the connecting line, into which power transmission means the transfer apparatus (13, 13*a,b*) is looped.

14. The intermediate storage apparatus according to claim 11, wherein the power transmission means or the drive belt (36*a,b*) is driven via a clutch mechanism by and synchronously with the associated winding station (D1, . . . , D4).

15. The intermediate storage apparatus according to claim 5, wherein the conveying means (37*a-d*) for transporting the planar articles on the connecting lines (14, 14*a,b*) are driven via a clutch mechanism by and synchronously with the associated winding station (D1, . . . , D4).

16. The intermediate storage apparatus according to claim 1, wherein a plurality of supply lines (11, 11*a,b*) and/or discharge lines (12, 12*a,b*) are provided.

17. The intermediate storage apparatus according to claim 1, wherein intermediate stations (17, 17*a,b*) for preparing the retrieved imbricated stream of planar articles for subsequent treatment steps are arranged at the end of the discharge line(s) (12, 12*a,b*).

18. The intermediate storage apparatus according to claim 17, wherein the intermediate stations (17, 17*a,b*) are capable of changing the position of the planar articles relative to one another in the imbricated stream.

19. The intermediate storage apparatus according to claim 17, wherein the intermediate stations (17, 17*a,b*) include at least one additional inlet for the supply of additional flat articles via an adjacent feed apparatus (18, 18*a,b*).

20. The intermediate storage apparatus according to claim 17, wherein the intermediate stations (17, 17*a,b*) can have various delivery paths (28, 29).

21. A method for operating an intermediate storage apparatus according to claim 1, wherein, for the spooling of flat articles led up via a selected supply line (11, 11*a,b*) in a selected winding station (D1, . . . , D4), the transfer apparatus (13, 13*a,b*) belonging to the selected winding station (D1, . . . , D4), on the connecting line (14, 14*a,b*) belonging to the selected winding station (D1, . . . , D4), is moved to the junction of the selected supply line (11, 11*a,b*) with the connecting line (14, 14*a,b*) belonging to the selected winding station (D1, . . . , D4), and in that, for the discharge of flat articles unspooled in the selected winding station (D1, . . . , D4) an associated transfer apparatus (13, 13*a,b*) is moved via a selected discharge line (12, 12*a,b*) to the junction of a selected discharge line (12, 12*a,b*) with the connecting line (14, 14*a,b*) belonging to the selected winding station (D1, . . . , D4), and the transport direction of the flat articles in the associated transfer apparatus (13, 13*a,b*) and on the connecting line (14, 14*a,b*) is reversed.

* * * * *